US005190435A

United States Patent [19]

Epstein

[11] Patent Number: 5,190,435

[45] Date of Patent: Mar. 2, 1993

[54] FORK LIFT TRUCK

[75] Inventor: Irving Epstein, Mercer Island, Wash.

[73] Assignee: Washington Chain and Supply, Inc., Seattle, Wash.

[21] Appl. No.: 277,252

[22] Filed: Nov. 29, 1988

[51] Int. Cl.[5] ..... B66F 9/14

[52] U.S. Cl. ..... 414/635; 187/9 R; 414/634; 414/638

[58] Field of Search ..... 414/282, 283, 286, 630, 414/631, 632, 633, 634, 635, 636, 637, 638; 187/9 R, 9 E

[56] References Cited

U.S. PATENT DOCUMENTS

| | | | |
|---|---|---|---|
| 1,556,262 | 10/1925 | Streeter . | |
| 1,837,486 | 12/1931 | Remde . | |
| 2,421,472 | 6/1947 | Way . | |
| 2,504,885 | 4/1950 | Schreck | 414/635 X |
| 3,240,372 | 3/1966 | Joyce et al. . | |
| 3,445,019 | 5/1969 | Steinert . | |
| 3,497,095 | 2/1970 | Couberly . | |
| 3,522,896 | 8/1970 | Newton . | |
| 3,610,453 | 10/1971 | Goodacre . | |
| 3,826,393 | 7/1974 | Carroll . | |
| 3,907,141 | 9/1975 | Ahrendt et al. | 187/9 R X |
| 3,937,346 | 2/1976 | van der Laan | 414/666 |
| 4,102,463 | 7/1978 | Schmidt . | |
| 4,365,921 | 12/1982 | Brouwer et al. . | |
| 4,460,064 | 7/1984 | Lutz et al. | 187/9 R |
| 4,538,954 | 9/1985 | Luebke . | |

FOREIGN PATENT DOCUMENTS

| | | | |
|---|---|---|---|
| 248860 | 5/1963 | Australia | 414/633 |
| 699730 | 12/1964 | Canada | 414/660 |

OTHER PUBLICATIONS

Crown—15SP48 Stockpickers Cart Handling—Published Sep. 1986.
Crown—SP42 Stockpickers.
Crown—30SP48 Stockpickers.
Crown—SP36 Stockpickers.
Baker.
Hyster—Electric Narrow Aisel Trucks.
Barrett "Cube King".
Clark-OP Series.

*Primary Examiner*—Frank E. Werner
*Attorney, Agent, or Firm*—Tom Secrest

[57] ABSTRACT

This invention relates to a forklift truck having a pedestal which is tiltable by a hydraulic cylinder and has an operator's cabin and forks positioned forwardly of and for movement along the pedestal.

21 Claims, 8 Drawing Sheets

FORK LIFT TRUCK

THE BACKGROUND OF THE INVENTION

In the preparation of the patent application a search was made. The search disclosed a number of interesting inventions. These are discussed in the following paragraphs.

Roger D. Luebke, U.S. Pat. No. 4,538,954, entitled STACKER CRANE HAVING NARROW MAST STRUCTURE, discloses a fork lift device having a suspended mast 7. The mast 7 is suspended from an overhead trolley which rides on rails 6. At the bottom of the mast 7 there is a vertically movable load supporting carriage 10 comprising a horizontally projecting load engaging fork 11. There is no frame having wheels which engage the floor.

Geradus J. Brouwer, U.S. Pat. No. 4,365,921 entitled FORKLIFT VEHICLE discloses two spaced apart frame members joined at the rear by a transverse member. The transverse member also is mounted for the seat of an operator. There is a fork carriage having forks. The fork carriage is moveable forwardly and rearwardly between the two frame members. There are four wheels with two of the wheels at the rear of the frame members and spaced closely together for steering the forklift vehicle. The forks can move vertically on the forklift carriage. There are hydraulic cylinders for rotating the forklift carriage both forwardly and rearwardly.

Hans Heinrich Schmidt, U.S. Pat. No. 4,102,463, entitled TRANSPORTER FOR SLAB CASTING TABLES, discloses a chassis 12 having ground engaging wheels 13 and 14. There is a steering wheel 15 in front of the transporter. There is centrally located vertically sending mast 19. On the upper end of the mast 19 there is an upper table support frame 22.

Henry F. Carroll, U.S. Pat. No. 3,826,393, entitled SELF-PROPELLED UNLOADER, discloses an unloader having, essentially three contact points with the ground or three sets of wheels with the ground. The position of the contact areas is varied by means of hydraulic cylinders for moving the wheels or contact areas with respect to the frame of the unloader. There is a set of forks 42 which can be elevated. Also, with a load the two contact area's or two wheels can be moved so as to provide more stability for the unloader.

Cecil Goodacre, U.S. Pat. No. 3,610,453, entitled INDUSTRIAL TRUCK, teaches of a truck having a body portion with two spaced apart wheels. There is pivotly attached to the body portion two straddle legs. Each of the straddle legs is on the front or extended end of the wheel. There is a mast optively connecting with the front of the straddle legs. There is a load lifting carriage on the mast. There is no position for an operator to sit and to operate the industrial truck and the load lifting carriage.

John R. Newton, U.S. Pat. No. 3,522,896, entitled LIFT TRUCK, discloses a large lift truck having a frame and wheels. The operator's station and the controls are at the rear of the frame. There is a tiltable or moveable set of lift arms 1. Also, there are clamp arms 91. The lift truck can lift large and heavy objects such as a log or a number of logs or a pipe or a number of pieces of pipe and the like.

Benjamin L. Couberly, U.S. Pat. No. 3,497,095, entitled COUNTERBALANCE APPARATUS FOR A LIFT TRUCK, teaches of a lift truck having a frame and four wheels. There is a steering wheel 36 in the central part of the lift truck. On the front end of the lift truck there is a tiltable lift mast 20 operatively connecting with a lift fork 12. It is possible to vary the elevation of the lift mast 20 thereby varying the elevation of the lift fork 12. Also, as lift mast 20 is tiltable the lift fork 12 is rotatable.

Kurt Steinert, U.S. Pat. No. 3,445,019, entitled FORK LIFT TRUCK HAVING A LIFTING DEVICE MOUNTED FOR PIVOTAL MOVEMENT ABOUT A VERTICAL PIVOTAL AXLE, discloses a fork lift truck having a "C" frame with four spaced apart wheels. There is a mast and a mechanism for raising and lowering a set of forks. The fork lift truck is such that the forks can be on the side or the forks can be rotated and at one end. In other words, it is possible for the forks to pick up an object on the side of the truck and elevate the object to be at the end of the truck.

James E. Joyce, U.S. Pat. No. 3,240,372, entitled EXTENSIBLE MOUNTING APPARATUS FOR HOISTS, teaches of a lift truck in a "U" configuration having a main body portion at the base and two spaced apart legs 10. There is a mast 14. On the mast 14 are two fork tines 30. The mast 14 and the fork tines 30 can move along the two spaced apart legs so that the tines can extend beyond the end of the legs 10 or the tines can be retracted so as to be, mainly, between the legs 10. There is a steering wheel and a place for an operator to stand and to operate the fork lift truck.

Glen W. Way, U.S. Pat. No. 2,421,472, entitled ENDLESS TREAD INDUSTRIAL TRUCK, teaches of the crawler tractor having mast member 11 and 12. Forks 31 operatively connect with mast members 11 and 12.

Edward H. Remde, U.S. Pat. No. 1,837,486, entitled INDUSTRIAL TRUCK, teaches of a truck having a frame with wheels. On one end of the frame there is an operator's platform on which an operator can stand and maneuver the truck and lifting apparatus. At the other end of the frame there is a lifting apparatus comprising forks 29. There is a first mast and a second mast. The forks are associated with the second mast. There is an apparatus on the first mast for raising the housing for the second mast.

Albert W. Streeter, U.S. Pat. No. 1,556,262, entitled ELEVATOR AND ELEVATOR TRUCK, comprising a truck having a frame and four spaced apart wheels. At one end of the frame there is a platform 20 of which an operator can stand and maneuver the truck and the lifting apparatus. At the other end of the frame there is a platform 12 which can be moved vertically. There is a winch 15 connecting with platform 12 for moving the platform vertically.

Generally, there is a frame which is heavy so as to provide stability for a load to be lifted. There is a propelling means and a place for an operator to sit or to stand to control the operation of the truck. On one end of the fork lift truck there is a set of forks which can be elevated or lowered for lifting and lowering a load.

In certain instances there are specialized fork lift trucks for one or two specific applications.

A GENERAL DESCRIPTION OF THE INVENTION

This invention is directed to a fork lift truck which I consider to be new and useful. There is a frame with four wheels. There is a set of two spaced apart front wheels and a set of two spaced apart rear wheels. The front wheels are spaced apart from the rear wheels. There is a pedestal at approximately the center of the frame. The pedestal is positioned between the front wheels and the rear wheels. Also, the pedestal maybe positioned between the one set of front and rear wheels and the other set of front and rear wheels. There is a cabin which operatively connects with the pedestal and can move upwardly and downwardly on the pedestal. The cabin can be on the front of the pedestal or on the back of the pedestal or on the side of the pedestal. The pedestal is positioned on a pin or a rod and can be rotated forwardly or rotated rearwardly. With the cabin mounted on the pedestal and the pedestal capable of being rotated it is possible for the operator in the cabin to have a better view of the surrounding area and therefore more accurately can see the object or objects on the fork in the proper place.

The forks extend beyond the front of the frame and beyond the wheels of the fork lift truck.

THE DRAWINGS

In the drawings it is seen:

THE SPECIFIC DESCRIPTION OF THE INVENTION

Figure 10:
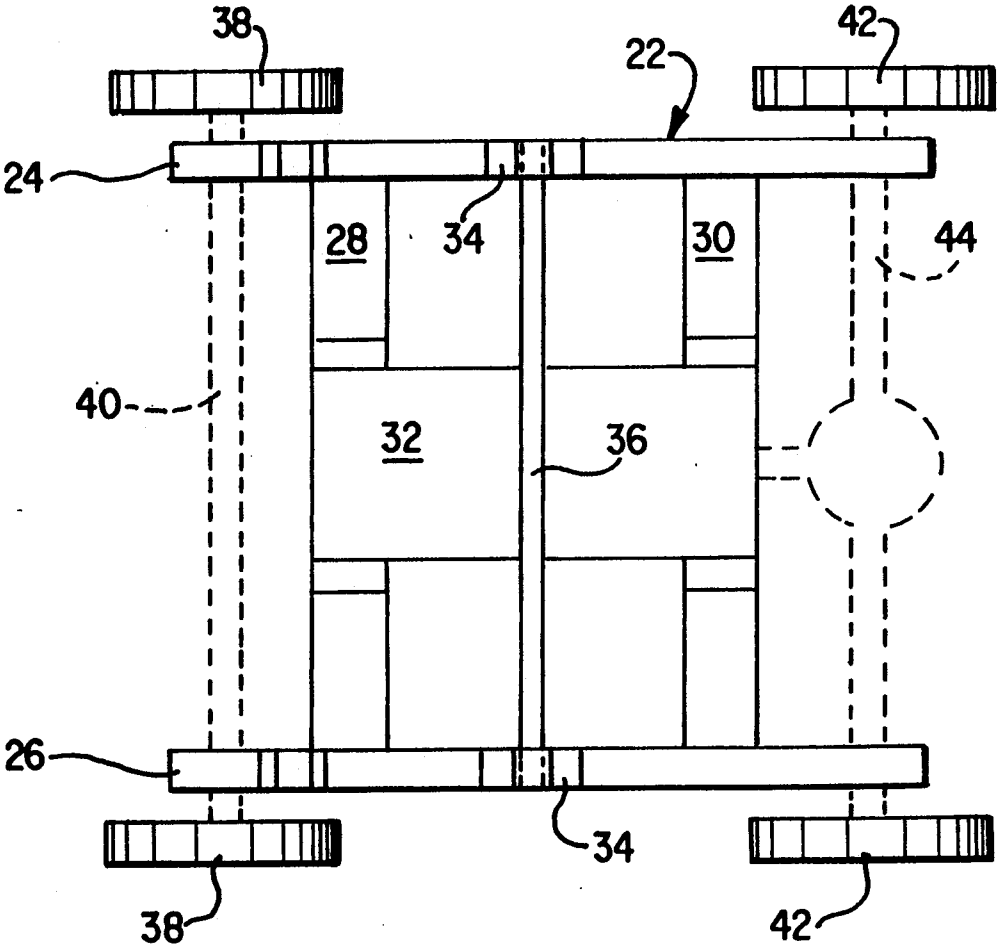
FIG. 10 is a schematic illustration of the frame for the fork lift truck.

With reference to the drawings it is seen that the invention is a fork lift truck 20 having a frame 22, see FIG. 10.

The frame 22 comprises of spaced apart longitudinal members 24 and 26. The members 24 and 26 are joined by two spaced apart lateral members 28 and 30. The central portion of each member 28 and 30 is raised or elevated. A support plate 32 is connected to the upper part of each of the members 28 and 30.

At approximately the central part and on the upper surface of each longitudinal member 24 and 26 there is positioned a pillow block 34 having a bearing for receiving the pin or rod 36. The pin or rod 36 is lateral to the longitudinal members 24 and 26 and parallel to the lateral members 28 and 30.

In FIG. 10 it is seen that at the left of the frame there is a first set of wheels 38 connected by an axle 40. At the right of the frame there is a second set of wheels 42 connected by an axle 44.

Figure 7:
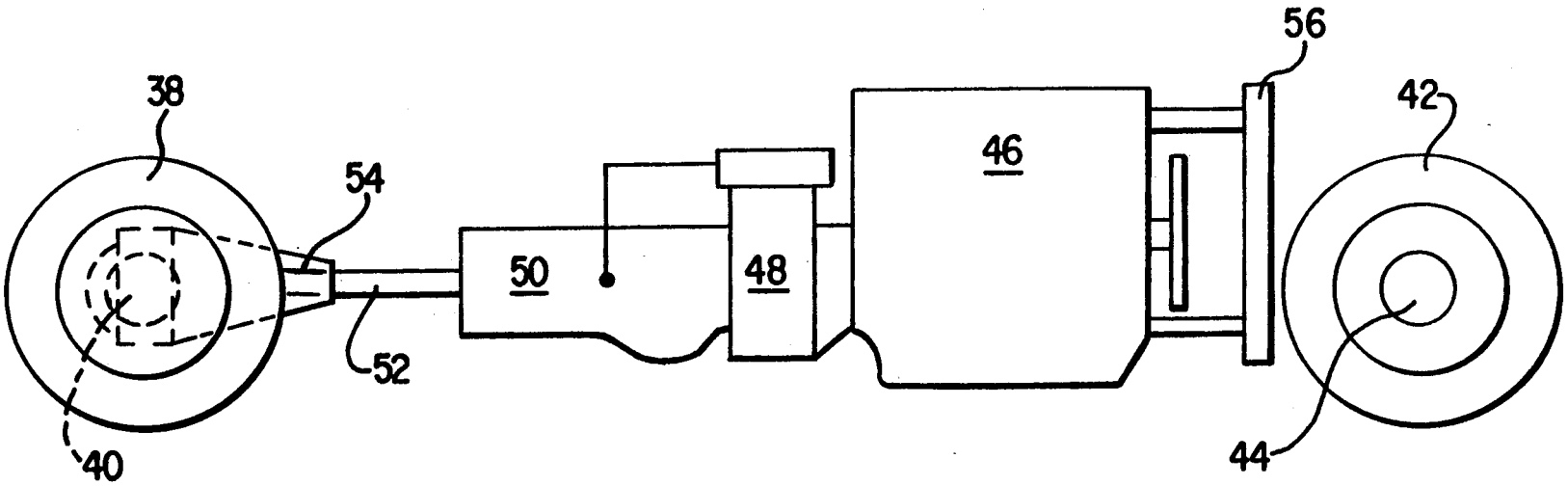
FIG. 7 is a side elevational view of the propulsion apparatus for the fork lift truck and illustrates the wheels, an engine, a transmission and a differential.

With reference to FIG. 7 it is seen that the running gear of the fork lift truck 20 comprises a propulsion unit 46 such as a gasoline engine or a diesel engine or a gas engine operatively connecting with a torque converter 48. A transmission 50 connects with a torque converter and a drive shaft 52 which in turn connects with a differential 54. A radiator 56 connects with the engine.

In the drawings it is seen that there is a pedestal 60 comprising two spaced apart upright members 62 and 64. Each of the members 62 and 64 is a "U-Channel" having a base 66, a first leg 68 and a second leg 70. There is an upper cross brace 72 connecting to the upper part of each upright member 62 and 64.

The upright members 62 and 64 at their lower ends operatively connect with the pin 36 so as to be able to rotate around the pin 36. In this manner the pedestal 60 can rotate forwardly and can rotate rearwardly.

Figure 5:
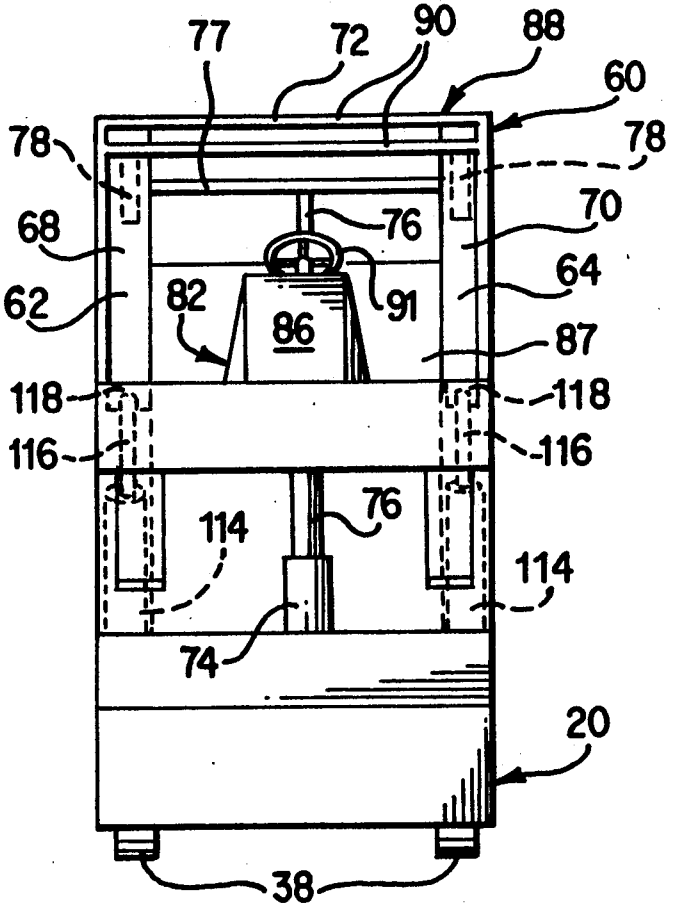
FIG. 5 is a front elevational view of the fork lift truck which shows the cab and the forks in an elevated position on the pedestal.

There is positioned above the pin 36 a multistage hydraulic cylinder 74 having a ram 76. In FIG. 5 it is seen that there is an axle 77 having a wheel or roller 78 on each end. The wheels 78 run in the upright members 62 and 64 and between the legs 68 and 70. The outer end of the ram 76 operatively connects with the axle 77 so as to be able to move the axle 77 and the wheels 78 with respect to the upright members 62 and 64. The lower end of the cylinder 74 can connect with a lug 80. Lug 80 is positioned on the pin 36. The lug 80 can be welded to the cylinder 74. The lug 80 has an aparture and bearing 81 for receiving the pin 36 and for allowing the lug 80 and the pin 36 to rotate with respect to each other.

There is an operator's cab 82. The cab 82 has side panels 84, a front panel 86 and a rear panel 87.

On the operator's cab 82 there is a protective cage 88 having bars 90 to protect the driver from stray objects.

In the operator's cab 82 there is a steering wheel 91 and a steering column 92 for steering the fork lift truck 20.

As part of the structure of the cab 82 are forks 96. The forks 96 operatively connect with the side panels 84 and the front panels 86 such as a weld. The forks 96 comprise upright members 98 and two spaced apart prongs 100. The prongs 100 are directed outwardly from the fork lift truck 20 and are positioned on the outside of the first set of wheels 38.

Figure 6:
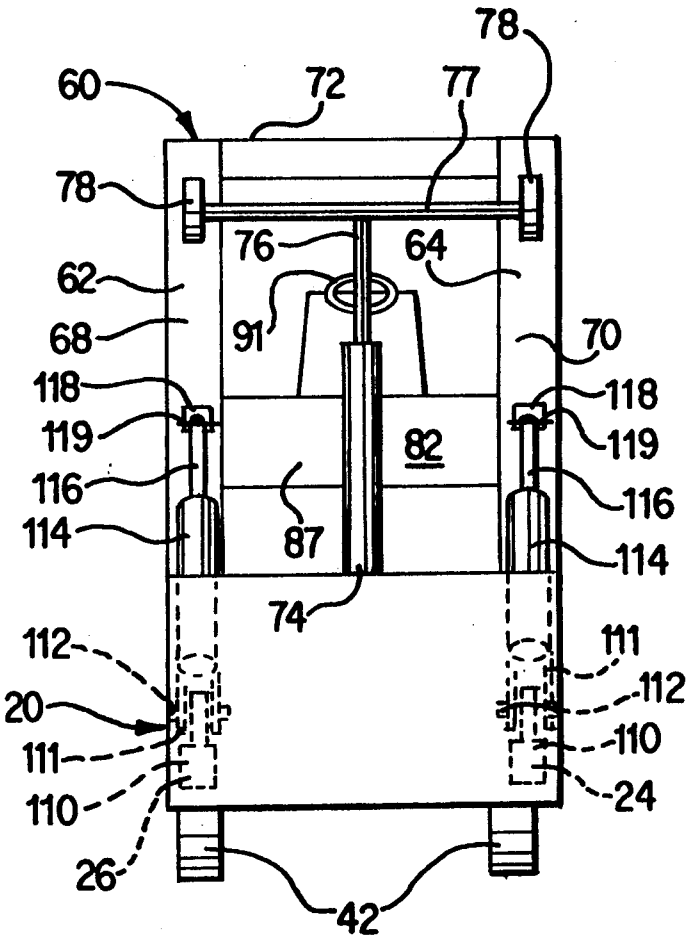
FIG. 6 is a rear elevational view of the fork lift truck illustrating the pedestal and the two hydraulic cylinders for rotating the pedestal, and the cab in an elevated position on the pedestal.
Figure 9:
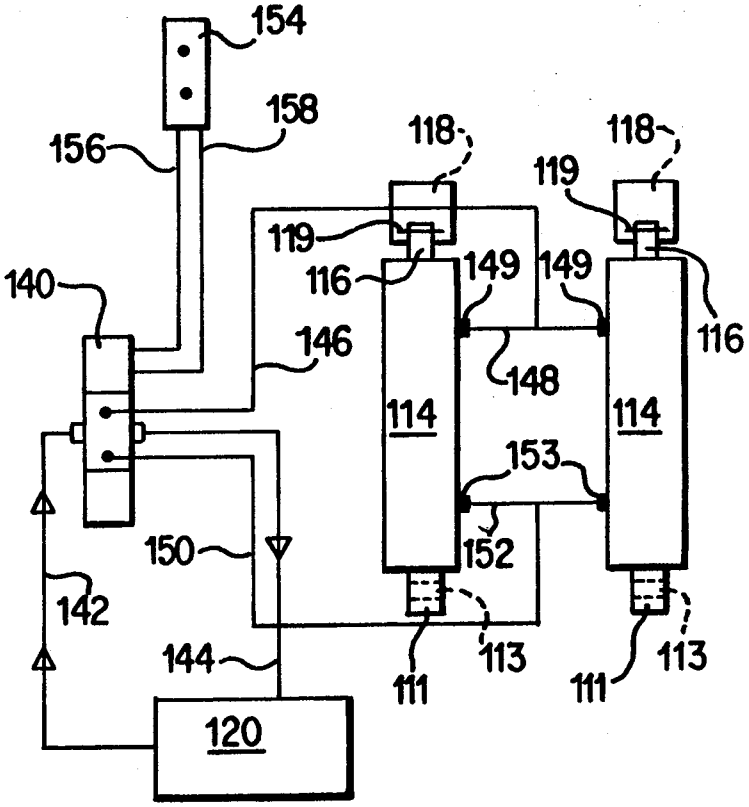
FIG. 9 is a schematic illustration of the hydraulic system for rotating the pedestal forwardly and rearwardly.

With respect to FIGS. 6 and 9 it is seen that there are two spaced apart pillow blocks 110 on the frame 22. One of the pillow blocks 110 is on the longitudinal member 24 and near the second set of wheels 42. The other pillow block 110 is on the longitudinal member 26 and near the second set of wheels 42. There is a pin 112 in each pillow block. There is a lug 111 operatively connecting with the pin 112. In the lug 111 there is an aperture and bearing combination 113. The lug 111 and the pin 112 rotate with respect to each other. There are two hydraulic cylinders 114. On the lower end of each hydraulic cylinder 114 there is a lug 111. Each hydraulic cylinder 114 has a ram 116.

With reference to FIG. 6 it is seen that there is a connector or adapter 118 on the back of the first member 62 and also on the back of the second member 64. The ram 116 connects with the connector 118 so that the member 62 can rotate with respect to the ram 116 and the member 64 can rotate with respect to the ram 116. In this manner the members 62 and 64 and, therefore, the pedestal 60, can rotate around the pin 94.

Figure 1:
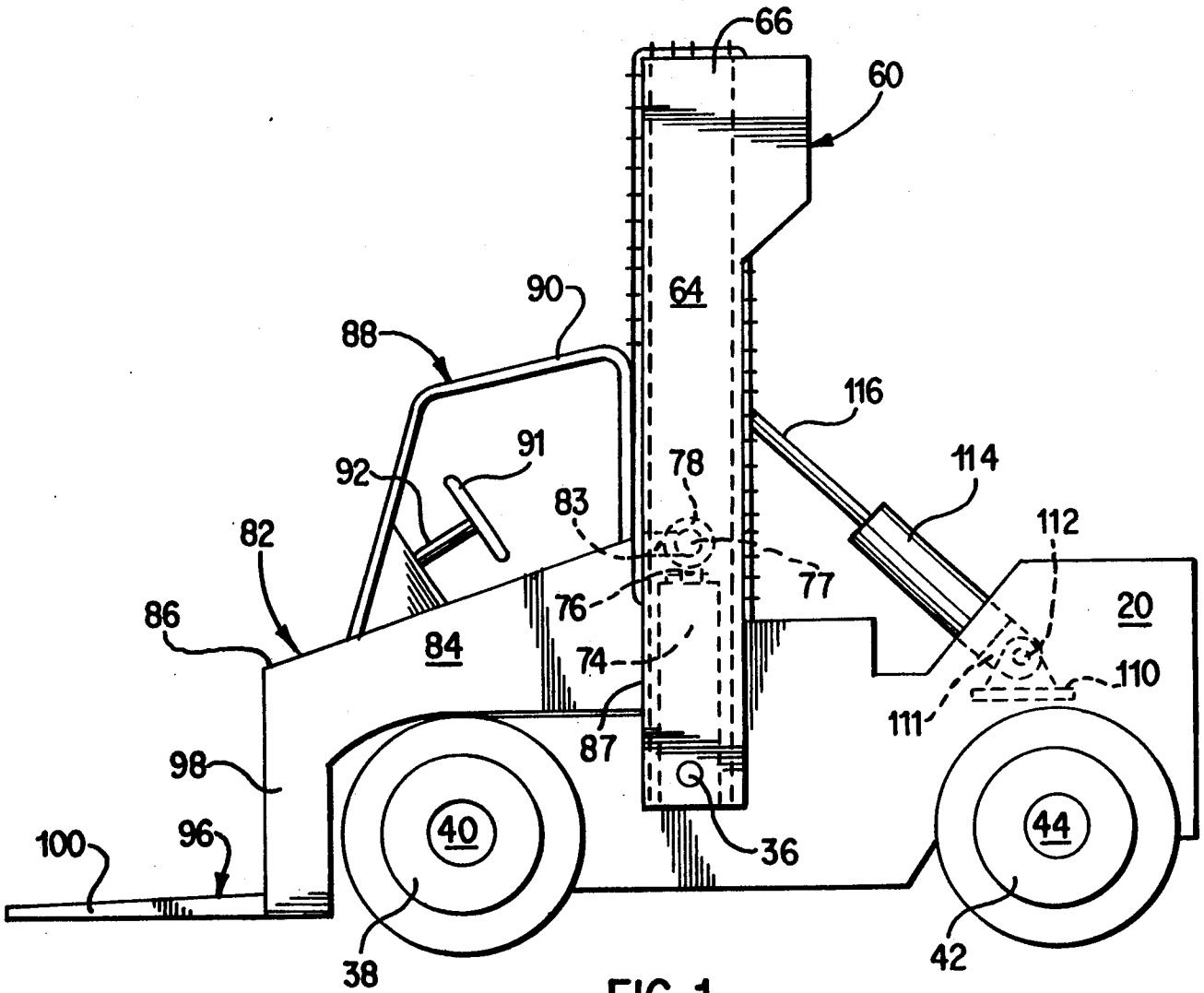
FIG. 1 is a side elevational view of the fork lift truck showing the frame, the front wheel, the rear wheel, the pedestal positioned on the frame between the front wheel and the rear wheel, the cab positioned on the pedestal and a fork also operatively connecting with the pedestal and with the cabin, and the cab and the forks in a lowered position on the pedestal.
Figure 2:
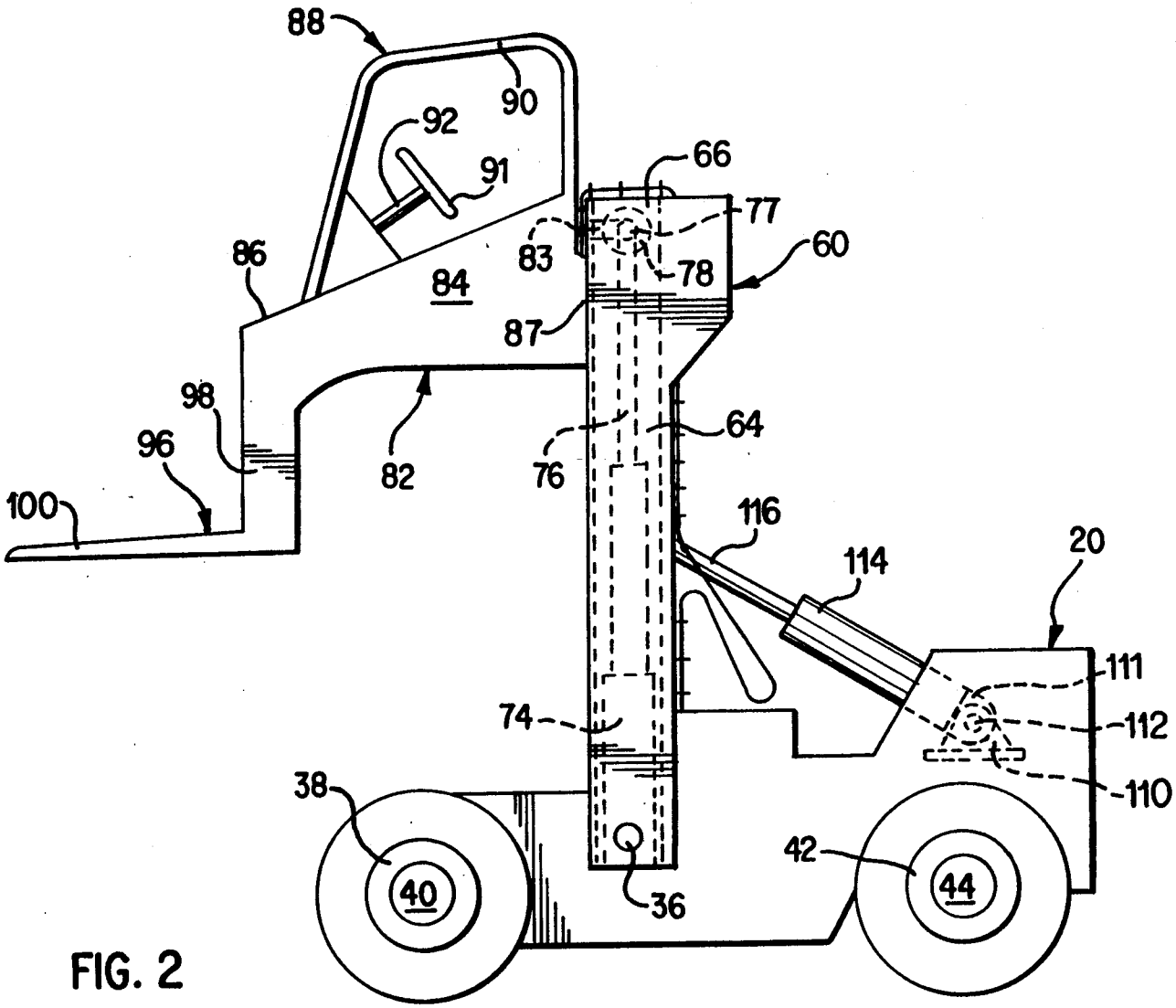
FIG. 2 is a side elevational view of the fork lift truck and illustrates the cab as elevated on the pedestal and therefore the forks are in an elevated position.
Figure 3:
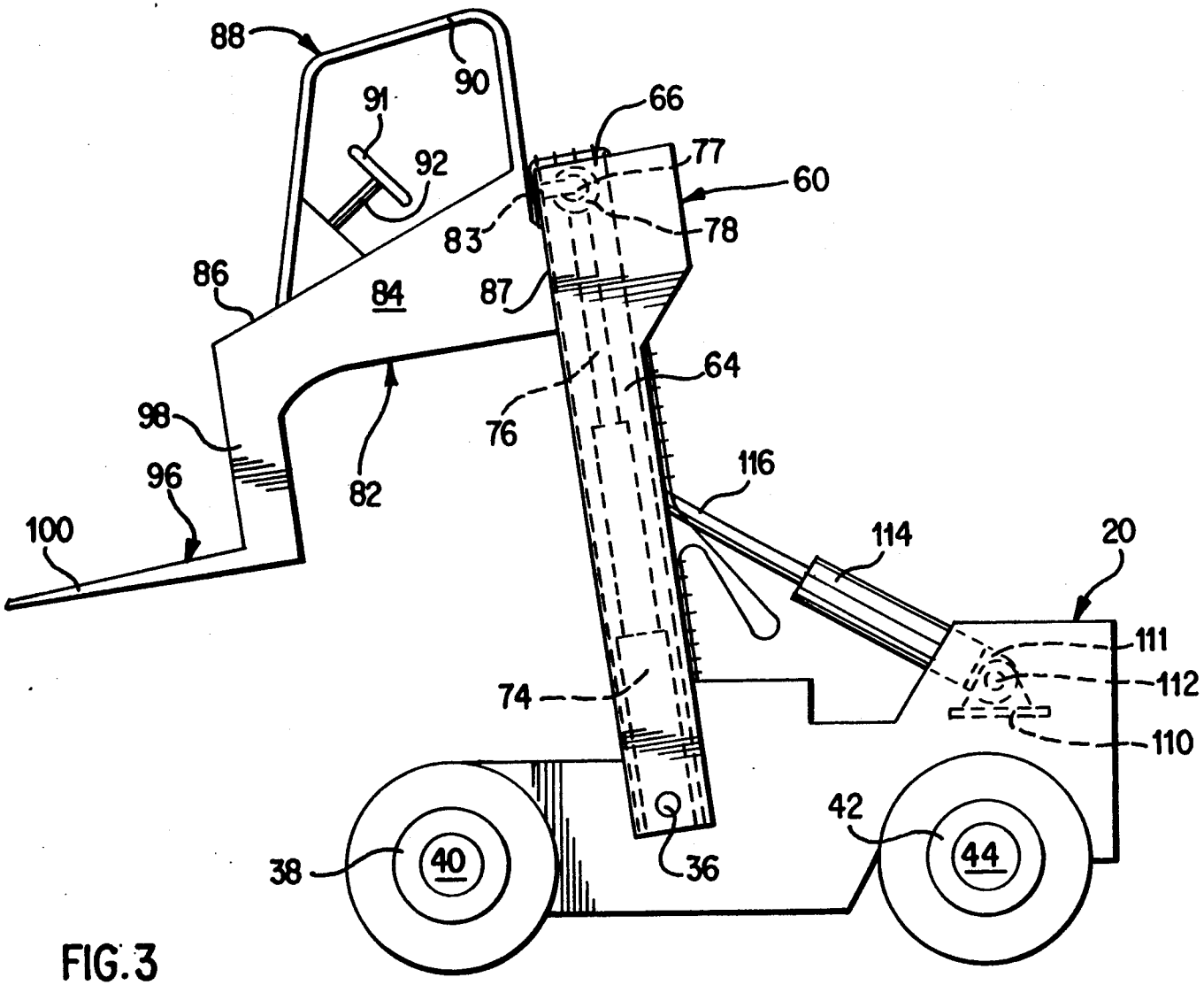
FIG. 3 is a side elevational view of the fork lift truck and shows the ram of the hydraulic cylinder extended so as to rotate the pedestal, the cab and the forks forwardly.

With the extension of the ram 116 the pedestal 60, with respect to FIG. 3, rotates forwardly and toward the axle 40 and the first set of the wheels 38. Likewise, the forks 96 rotate forwardly and slope downwardly.

Figure 4:
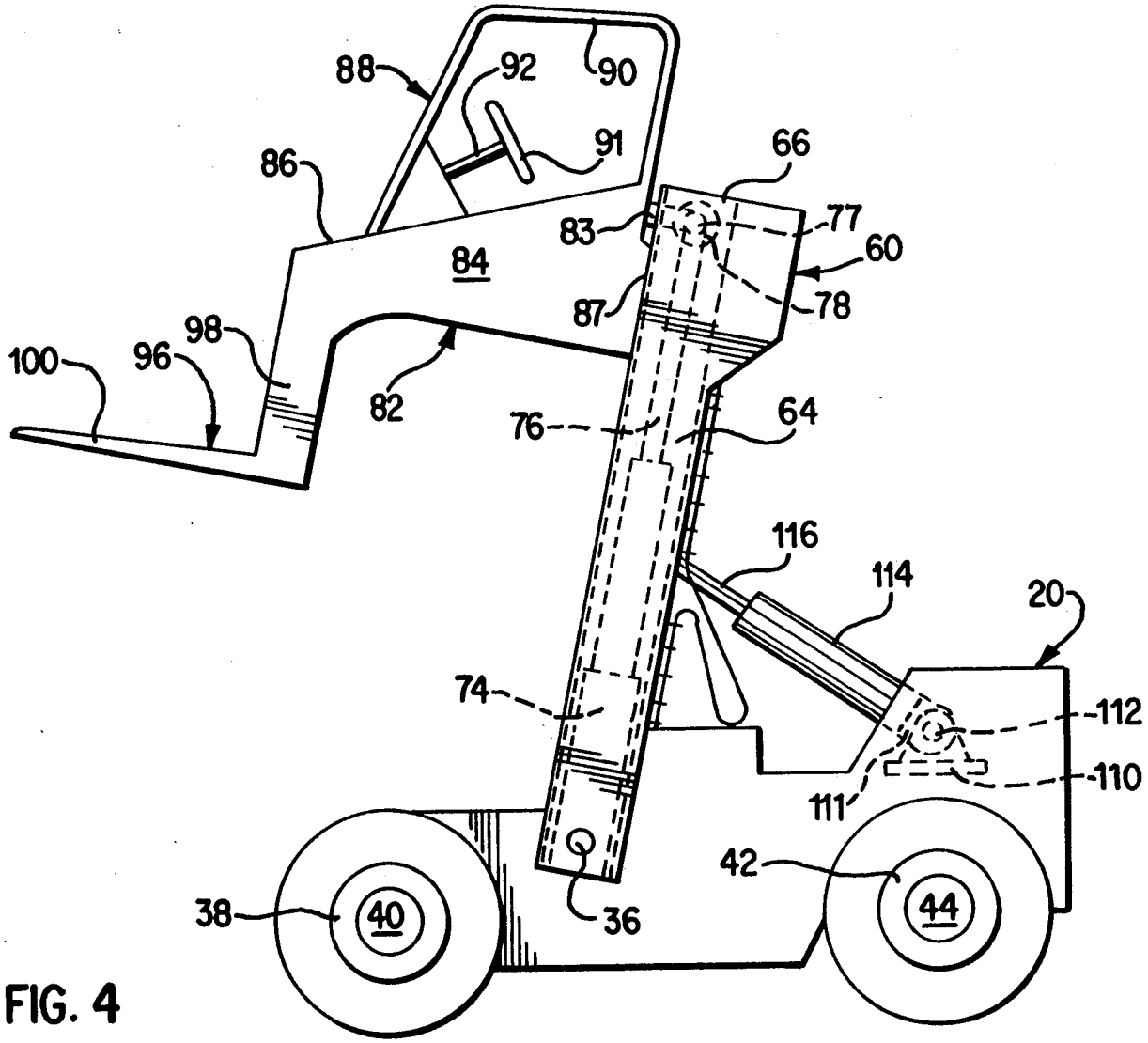
FIG. 4 is a side elevational view of the fork lift truck and shows the ram of the hydraulic cylinder retracted so as to rotate the pedestal, the cab and the forks rearwardly.

With the retraction of the ram 116, see FIG. 4, the pedestal 60 rotates around the pin 94 and rearwardly toward the axle 44 and the second set of wheels 42. Likewise, the forks 96 rotate rearwardly and slope upwardly.

The connector 118 comprises a pin 119. The ram 116 can rotate around the pin 119 or, the pin 119 and the ram 116 can rotate with respect to each other.

Figure 8:
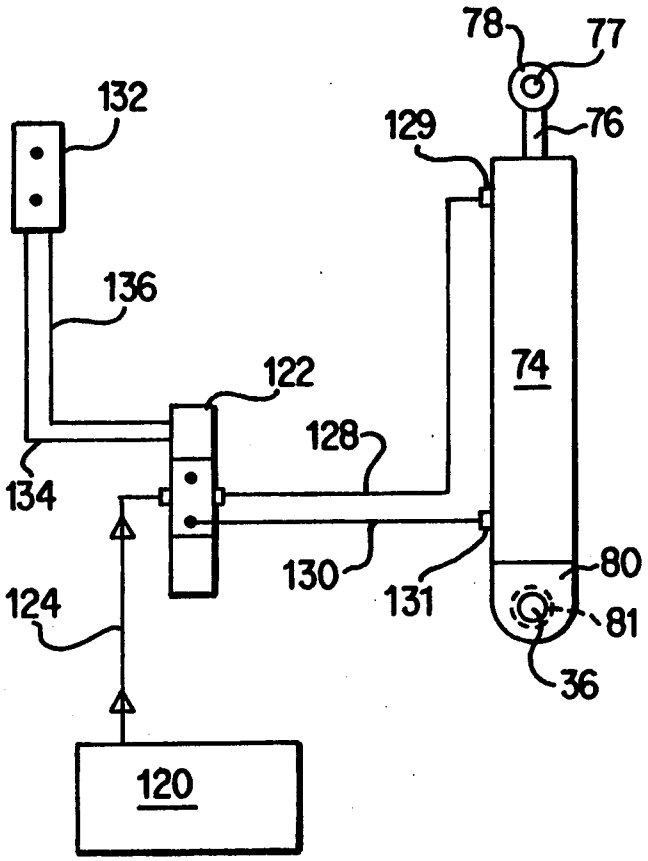
FIG. 8 is a schematic illustration of the hydraulic hoist cylinder and ram for elevating the control cab and the forks.

In FIG. 8 there is a schematic illustration of the hydraulic system for raising and lowering the cross brace and axle combination 77 positioned between the members 62 and 64 of the pedestal 60. The cab 82 is welded or operatively connected at 83 to the cross brace and axle combination 77. With the change of elevation of the combination 77 there is a corresponding change in the elevation of the cab 82 and also of the forks 96. For, example, if the ram 76 of the hydraulic cylinder 74 is extended the cross brace and axle combination 77 is elevated and therefore the cab 82 is elevated and the forks 96 are elevated.

Conversely, if the ram 76 is retracted the cross brace and axle combination 77 is lowered and, in use in there with, the cab 82 and the forks 96 are lowered.

In FIG. 8 it is seen that there is a schematic illustration of the hydraulic system for raising and lowering the cross brace axle 77 and the cab 82 and the forks 96. There is a motor and hydraulic pump 120. There is a three way valve 122. A hydraulic pressure line 124 connects the pump 120 and the valve 122.

A first line 128 connects the three way valve 122 with the upper connector 129 of the hydraulic cylinder 74. The second hydraulic line 130 connects the three way valve 122 with the lower connector 131.

To extend the ram 76 the three way valve 122 is set so that hydraulic fluid flows through the line 130 to the lower connector 131.

To retract the ram 76 the three way valve 122 is set that hydraulic fluid flows through the line 128 to the upper connector 129.

There is a control switch 132 having electric lines 134 and 136 connecting with the three way valve 122.

In FIG. 9 there is a schematic illustration of the hydraulic system for the two hydraulic cylinders 114 for rotating the pedestal 60 forwardly and for rotating the pedestal 60 rearwardly.

There is a motor and a pump combination 120. There is a four way valve 140. The hydraulic pressure line 142 connects the valve 140 and the motor and pump combination 120.

A return line 144 connects the valve 140 and the motor and pump 120.

A hydraulic line 146 connects with the common line 148. The common line 148 connects with an upper connector 149 on each of the hydraulic cylinders 114.

There is a second line 150 which connects with the four way valve 140 and with the common line 152. The common line 152 connects with a lower connector 153 on each of the hydraulic cylinders 114.

There is a control switch 154 having electrical lines 156 and 158 which connects with the four way valve 140.

To rotate the pedestal 60 forwardly the four way valve is set so as to force the hydraulic fluid through the line 150 and the common line 152 to the lower connectors 153. This extends the ram 116 so as to rotate the pedestal 60 around the pin 94 toward the first set of wheels 38 and forwardly. With the ram 116 being extended the hydraulic fluid flows from the hydraulic cylinder 114 thru the common line 148, first line 146, to the valve 140 and to the motor and pump 120.

To rotate the pedestal 60 rearwardly the hydraulic rams 116 are retracted into the hydraulic cylinders 114. The hydraulic fluid under pressure flows from the motor and pump 120 through the pressure line 142, through the four way valve 140 and to the first line 146. From the first line 146 it goes to the common line 148 to the upper connector 149. This retracts the ram 116. With the retraction of the ram 116 the pedestal rotates around the pin 94 and rearwardly and toward the second set of wheels 42.

The engine for the fork lift truck can be one of many such as a gasoline engine, a diesel engine, a gas engine and an electric motor with batteries.

A fork lift truck with a gasoline engine or diesel engine or a gas engine will have a torque converter type transmission as used on a standard lift truck.

The fork lift truck will have appropriate weight for stability. For example, since there will be a weight on the forks there should be a counter weight on the frame of the fork lift truck.

Also, the fork lift truck can be in various sizes from a small truck to a large truck.

It is to be noted that the pedestal can rotate forwardly or rearwardly or can be substantually vertical.

The fork lift truck has been displayed with four wheels. It is conceivable that in place of the four wheels there can be used endless crawler tracks such as on earth moving equipment. This is a specialized version of the fork lift truck but endless crawler trucks can be used.

35 U.S.C. 101 states; "Inventions patentable. Whoever invents or discovers any new and useful process, machine, manufacture, or composition of matter, or any new and useful improvement thereof, may obtain a patent therefor, subject to the conditions and requirements of this title."

35 U.S.C. 103 states; "Conditions of patentability; A patent may not be obtained though the invention is not identically disclosed or described as set forth in section 102 of this title, if the differences between the subject matter sought to be patented and the prior art are such that the subject matter as a whole would have been obvious at the time of the invention was made to a person having ordinary skill in the art to which said subject matter pertains."

It is argued that the subject invention is useful as it is a fork lift truck for lifting objects and transporting those objects. In fact, the forks can be elevated or lowered. The forks can pick up and lift an object, transport the object and then lower the object or can elevate the object to be placed at a higher elevation and then the forks removed. Or, the forks can go underneath an object at a higher elevation and lift this object, transport the object to a new location and leave the object at the new location, the location being low or high.

One of the main advantages of this fork lift truck is that the pedestal is centrally located between the rear axle and the front axle of the truck. Also, the pedestal is located between the supports on one side and the supports on the other side of the truck. The supports may be wheels or can be endless tracks. There is a front set of wheels and also a rear set of wheels. The pedestal is positioned between the front set of wheels and the rear set of wheels or between the front axle and the rear axle.

There is a first set of wheels on one side of the truck and a second set of wheels on the other side of the truck. The pedestal is between the first set of wheels and the second set of wheels. If an endless track is used there is a first set of tracks on one side of the truck and a second set of tracks on the other side of the truck. The pedestal is between the first track on one side of the truck and the second track on the other side of the truck. This adds to the stability of the fork lift truck.

A major advantage of this fork lift truck is that the operator is close to the forks. In many fork lift trucks the support for the forks is between the operator and the forks. For example, the forks run up and down or vertically on the support or pedestal. The pedestal is between the forks and the operator. The operator may have a heavy load or a bulky load on the forks. The operator in operating the fork lift truck must peer around the pedestal and the forks and the load. In certain instances the operator does not have a good view of what is in front of him. In these instances there is a good possability of a wreck or accident. The vision of the operator is hindered or blurred by the support and the bulky load on the forks.

The forks extend beyond the front axle or the front wheels of the fork lift truck.

The cab is mounted so as to move upwardly and downwardly on the pedestal on the central part of the fork lift truck. The operator of the truck can manuever the truck to have the forks at the load to be lifted. The load can be placed on the forks and the operator elevates the cab and the forks. The operator has a good view of what is in front of him as he moves the fork lift truck to its destination.

The pedestal is positioned on a pin so as to be capable of rotating. There is provisions for holding the pedestal in vertical position or for rotating the pedestal forwardly toward the front wheels of the front axle of the truck or for rotating the pedestal rearwardly toward the rear wheels or the rear axle of the truck. With the rotation of the pedestal there is a corresponding rotation of the forks.

Further, the forks and the cab move in unison on the pedestal. The forks are attached to the housing from the cab and with the movement of the cab on the pedestal the forks move in unison with the cab. For example, the cab is elevated the forks are elevated. The cab is lowered the forks are lowered.

Again, an important feature of this invention is the positioning of the cab in front of the mast or the pedestal and above the forks or the tynes so that the operator has a good view of the landscape in front of the fork lift truck. The position of the pedestal can be between the front axle and the rear axle, or conceivably, over the front axle. The position of the pedestal on the fork lift truck can vary depending upon the use of the truck. The use of the truck will influence the design of the fork lift truck. It is conceivable that the frame of the truck can extend beyond the front axle and that the pedestal can be positioned on the frame ahead of the front axle.

Reference number 160 refers to a conduit type cable and hose carrier. This is a flexible armored cable for protecting pneumatic and hydraulic hoses as well as electrical cables.

From the foregoing it is seen that I have presented a fork lift truck comprising an upright predestal; an operator's station operatively connecting with said pedestal; forks operatively connecting with said pedestal; said operator's station being positioned between said forks and said pedestal to give an operator unobstructed visibility; a first means to change the elevation of said operator's station and said forks; a second means to rotate said pedestal away from a vertical position; and, a third means to move said fork lift truck. Also, I have provided a fork lift truck comprising said first means and said operator's station operatively connecting with each other. The operator's station is a cab with said cab and said first means operatively connecting with each other; and said cab and said forks operatively connecting with each other. The cab includes said forks with said forks being an extension of said cab and projecting forwardly of said cab; said cab having a position for an operator; said forks being at a lower elevation than said position for an operator. In said fork lift truck said first means being a first combination of a fluid actuated cylinder and a ram; said cab operatively connecting with said first combination. In said fork lift truck the lower end of said upright pedestal operatively connecting with an axis of rotation; said second means being a second combination of a fluid actuated cylinder and a ram; and, said pedestal and said second combination operatively connecting together to rotate said upright pedestal around said axis of rotation. Said third means comprising moveable ground engaging means for moving said fork lift truck from place to place; and, a source of power to move said ground engaging means. In said fork lift truck the lower end of said upright pedestal operatively connecting with an axis of rotation; said second means being the second combination of a fluid actuated cylinder and a ram; and, said pedestal and said second combination operatively together to rotate said upright pedestal and said forks around said axis of rotation to vary the position of the forks from pointing upwardly to pointing downwardly and, conversely, from pointing downwardly to pointing upwardly; said third means comprising moveable ground engaging means for moving said fork lift truck from place to place; and, a source to power to move said ground engaging means; said fork lift truck having a frame; said, third means operatively connecting with said frame; and, said pedestal opertively connecting with said frame. Said frame has a front axle; A1S frame has a rear axle; and, said pedestal operatively connects with said frame between said front axle and said rear axle.

Further, it is seen that I have provided a method for making a fork lift truck wherein said method comprises forming a frame; positioning an upright rotatable pedestal on said frame; operatively connecting an operator's station on said pedestal; operatively connecting forks with said pedestal; positioning said operator's station between said forks and said pedestal to give an operator unobstructed visibility; positioning a first means on said truck to change the elevation of said operator's station and said forks; positioning a second means on said truck to rotate said pedestal away from a vertical position and, positioning a third means on said truck to move said truck. Said method comprises operatively connecting together said first means and said operator's station. In said method making said operator's station a cab; operatively connecting together said cab and said first means; and, operatively connected together said cab and said forks. Said method comprises making unitary said cab and said forks; positioning said forks project forwardly of said cab; making a position in said cab for an operator; and, making said forks at a lower elevation than said position said cab for an operator. In said method making said first means a first combination of a fluid actuated cylinder and a ram; and, operatively connecting together said cab and said first combination. The method also comprises operatively connecting the lower end of said upright pedestal with an axis of rotation; making said second means a second combination of a fluid actuated cylinder and a ram; and, operatively connecting together said pedestal and said second combination to rotate said upright pedestal around said axis of rotation. The method comprises making said third means moveable ground engaging means for moving said fork lift truck from place to place; and, incorporating a source of power in said fork lift truck to move said ground engaging means; operatively connecting the lower end of said upright pedestal with an axis of rotation; making said second means a second combination of a fluid actuated cylinder and a ram; and, operatively connecting together said pedestal and said second combination to rotate said upright pedestal and said forks around said axis of rotation to vay the position of the forks from pointing upwardly to pointing downwardly and, conversely, from pointing downwardly to pointing upwardly; making third means moveable ground engaging means for moving said fork lift truck from place to place; and, incorporating a source of power in said fork lift truck to move said ground engaging means; operatively connecting said third means with said frame; and, operatively connecting said pedestal with said fram. In said method forming said frame with a front axle; forming said frame with a rear axle; and, operatively connecting said pedestal with said frame between said from axle and said rear axle.

What I claim as my invention is:

1. A fork lift truck comprising:
   a. a frame;
   b. an upright pedestal operatively connecting with said frame;
   c. an operator's station operatively connecting with said pedestal:
   d. forks operatively connecting with said pedestal:
   e. said operator's station being positioned between said forks and said pedestal to give an operator visibility unobstructed by said pedestal:
   f. a first means operatively connecting with said operator's station and said forks to change the elevation of said operator's station and said forks;
   g. a second means operatively connecting with said fork lift truck and said pedestal to rotate said pedestal away from a vertical position; and,
   h. a third means operatively connecting with said fork lift truck for movement of said fork lift truck in any direction on the ground.

2. A fork lift truck according to claim 1 and comprising:
   a. said first means and said operator's station operatively connecting with each other.

3. A fork lift truck according to claim 1 and comprising:
   a. said operator's station being a cab;
   b. said cab and said first means operatively connecting with each other;
   c. said cab and said forks operatively connecting with each other.

4. A fork lift truck according to claim 3 and comprising:
   a. said cab including said forks;
   b. said forks being an extension of said cab and projecting forwardly of said cab and forwardly of said pedestal;
   c. said cab having a position for an operator; and,
   d. said forks being at a lower elevation than said position for an operator in said cab.

5. A fork truck according to claim 4 and comprising:
   a. said first means being a first combination of a fluid actuated cylinder and a ram; and,
   b. said cab operatively connecting with said first combination.

6. A fork truck according to claim 5 and comprising:
   a. the lower end of said upright pedestal operatively connecting with an axis of rotation on said fork lift truck;
   b. said second means being a second combination of a fluid actuated cylinder and a ram; and,
   c. said pedestal and said second combination operatively connecting together to rotate said upright pedestal and said forks around said axis of rotation to vary the position of the forks from pointing upwardly to pointing downwardly and, conversely, from pointing downwardly to pointing upwardly;
   d. said third means comprising moveable ground engaging means for moving said fork lift truck from place to place; and,
   e. a source of power operatively connecting with said ground engaging means to move said fork lift truck;
   f. said third means operatively connecting with said frame; and,
   g. said pedestal operatively connecting with said frame.

7. A fork lift truck according to claim 6 and comprising:
   a. said frame having a front axle;
   b. said frame having a rear axle;
   c. said pedestal operatively connecting with said frame between said front axle and said rear axle.

8. A fork lift truck according to claim 1 and comprising:
   a. the lower end of said upright pedestal operatively connecting with an axis of rotation on said fork lift truck;
   b. said second means being a second combination of a fluid actuated cylinder and a ram; and
   c. said pedestal and said second combination and said frame operatively connecting together to rotate said upright pedestal around said axis of rotation.

9. A fork lift truck according to claim 1 and comprising:
   a. said third means comprising moveable ground engaging means for moving said fork lift truck from place to place; and,
   b. a source of power operatively connecting with said ground engaging means to move said fork lift truck.

10. A fork lift truck comprising:
a. a frame;
b. an upright pedestal on said frame;
c. a cab associated with said pedestal;
d. a means operatively connecting with said cab to move said cab vertically with respect to said pedestal;
e. said cab comprising an operator's station;
f. said cab comprising forks extending outwardly from said cab;
g. said cab being positioned between said pedestal and said forks;
h. ground engaging means for moving said fork lift truck on the ground;
i. a power source for supplying power to said means operatively connecting with said pedestal and for supplying power to said ground engaging means;
j. the lower part of said pedestal being on a pivot means;
k. said pivot means operatively connecting with said frame;
l. a rotating means operatively connecting with said frame and with said pedestal to rotate said pedestal and thereby to rotate said cab and said forks; and,
m. a power source for supplying power to and operatively connecting with said rotating means.

11. A fork lift truck according to claim 10 and comprising:
a. said operator's station being above said forks.

12. A fork lift truck according to claim 10 and comprising:
a. said means operatively connecting with said cab to move said cab vertically being a fluid actuated ram with part of said ram operatively connecting with said frame and part of said ram operatively connecting with said cab.

13. A fork lift truck according to claim 10 and comprising:
a. said forks extending outwardly beyond said frame.

14. A fork lift truck according to claim 10 and comprising:
a. said fork lift truck having a first and a second axle; and,
b. with said pedestal in a substantially vertical position said cab being substantially above said first axle.

15. A fork lift truck according to claim 14 and comprising:
a. two spaced apart wheels on said first axle; and,
b. two spaced apart wheels on said second axle.

16. A fork lift truck according to claim 15 and comprising:
a. said forks extend outwardly and beyond said first axle and said wheels on said first axle.

17. A fork lift truck according to claim 10 and comprising:
a. said rotating means being a fluid actuated ram.

18. A fork lift truck according to claim 10 and comprising:
a. said operator's station being above said forks;
b. said means operatively connecting with said cab to move said cab vertically being a fluid actuated ram with part of said ram operatively connecting with said frame and part of said ram operatively connecting with said cab;
c. said forks extending outwardly beyond said frame;
d. said fork lift truck having a first and a second axle;
e. the lower part of said pedestal being on a pivot means;
f. said pivot means operatively connecting with said frame;
g. a rotating means operatively connecting with said frame and with said pedestal to rotate said pedestal and thereby to rotate said cab and said forks; and,
h. a power source for supplying power to and operatively connecting with said rotating means.

19. A fork lift truck according to claim 18 and comprising:
a. said forks extend outwardly and beyond said first axle and said wheels on said first axle; and,
b. said rotating means being a fluid actuated ram.

20. A fork lift truck according to claim 19 and comprising:
a. said frame comprising two spaced apart longitudinal members and two spaced apart lateral members;
b. each lateral member operatively connecting with each longitudinal member;
c. a support plate connecting with each lateral member;
d. a rod operatively connecting with each longitudinal member;
e. said upright pedestal being rotatably positioned on said rod;
f. said fork lift truck having a first and a second axle;
g. with said pedestal in a substantially vertical position said cab being substantially above said first axle;
h. two spaced apart wheels on said first axle;
i. two spaced apart wheels on said second axle;
j. said operator's station being above said forks;
k. said means operatively connecting with said cab to move said cab vertically being a fluid actuated ram with part of said ram operatively connecting with said frame and part of said ram operatively connecting with said cab;
l. said forks extend outwardly and beyond said first axle and said wheels on said first axle;
m. a rotating means operatively connecting with said frame and with said pedestal to rotate said pedestal and thereby to rotate said cab and said forks; and,
n. said rotating means being a fluid actuated ram.

21. A fork lift truck according to claim 20 and comprising:
a. said power source being an internal combustion engine for allowing said fork lift truck to operate in a variety of ambient conditions.

* * * * *